US009791822B2

(12) United States Patent
Abe et al.

(10) Patent No.: US 9,791,822 B2
(45) Date of Patent: Oct. 17, 2017

(54) IMAGE FORMING APPARATUS HAVING AN OPENING-CLOSING MEMBER AND A LOCK MECHANISM

(71) Applicant: CANON KABUSHIKI KAISHA, Tokyo (JP)

(72) Inventors: Kenji Abe, Mishima (JP); Takashi Yano, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/087,140

(22) Filed: Mar. 31, 2016

(65) Prior Publication Data

US 2016/0291532 A1 Oct. 6, 2016

(30) Foreign Application Priority Data

Mar. 31, 2015 (JP) ..... 2015-073140
Feb. 17, 2016 (JP) ..... 2016-027968

(51) Int. Cl.
*G03G 15/00* (2006.01)
*G03G 21/16* (2006.01)

(52) U.S. Cl.
CPC ..... *G03G 21/1633* (2013.01); *G03G 2221/1654* (2013.01)

(58) Field of Classification Search
CPC ..... G03G 21/1633; G03G 21/1638; G03G 2221/1654
USPC ..... 399/110, 124
See application file for complete search history.

(56) References Cited

U.S. PATENT DOCUMENTS 7,684,731 B2 * 3/2010 Hirose et al. ..... G03G 21/1633 399/124
8,653,362 B2 * 2/2014 Tsujishita ..... G03G 21/1633 399/110

FOREIGN PATENT DOCUMENTS

JP 11-284364 A 10/1999
JP 2000-173257 A 6/2000
JP 2000-191005 A 7/2000
JP 2004-138775 A 5/2004

* cited by examiner

*Primary Examiner* — William J Royer
(74) *Attorney, Agent, or Firm* — Fitzpatrick, Cella, Harper & Scinto

(57) ABSTRACT

An image forming apparatus and a lock mechanism including a toggle mechanism capable of eliminating the problem of abnormal noise before and after a lock member passes a neutral point are provided. A lock mechanism includes a toggle spring that rotationally biases a toggle lever toward a standby position when the lever is between a standby position and a neutral point, and implements switching in a direction of the rotational biasing toward a locking position after the lever passes the neutral point. A projection and a locked portion of an engagement member are sandwiched by a toggle base and the toggle lever to maintain a contact state before and after the toggle lever passes the neutral point.

20 Claims, 10 Drawing Sheets

IMAGE FORMING APPARATUS HAVING AN OPENING-CLOSING MEMBER AND A LOCK MECHANISM

BACKGROUND OF THE INVENTION

Field of the Invention

The present invention relates to an image forming apparatus having an opening/closing member that is provided in an apparatus body so as to be freely opened and closed.

Description of the Related Art

A conventional image forming apparatus which uses an electrophotographic system in which a user replaces a component such as a toner cartridge by opening a cover is known. Various configurations related to a cover lock mechanism have been used. For example, Japanese Patent Application Publication No. 2004-138775 discloses a configuration in which a user operates a handle portion to switch the position of a lock claw between lock and unlock positions.

However, in the configuration in which a user operates a lever to change the lock and unlock positions of the cover, it is difficult for the user to identify the position of a handle, and the operating direction does not always correspond directly to the opening/closing direction. Thus, it cannot be said that such a configuration provides excellent usability.

Thus, a toggle mechanism capable of allowing a lock member to perform a lock/unlock operation automatically relative to a locked portion according to an opening/closing operation of the cover without requiring the user to operate the handle may be used.

However, a toggle mechanism has a neutral point at which biasing force is in equilibrium and has a point at which an engagement backlash is cancelled abruptly before and after a lock member passes the neutral point of the toggle mechanism. In this case, abnormal noise resulting from collision between the lock member and the locked portion is generated.

SUMMARY OF THE INVENTION

An object of the present invention is to provide a lock mechanism and an image forming apparatus including a toggle mechanism capable of eliminating the problem of abnormal noise before and after the lock member passes a neutral point.

An object of the present invention is to provide an image forming apparatus comprising:

an apparatus body of an image forming apparatus;

an opening-closing member configured to be opened and closed relative to the apparatus body;

a lock mechanism, provided in the apparatus body, configured to lock the opening-closing member to a locking position, the lock mechanism including a rotatable lock member and a biasing member that biases the lock member;

an engagement member, provided in the opening-closing member, configured to engage with the lock member, wherein the lock member is rotated by being pressed by the engagement member when the opening-closing member is closed relative to the apparatus body, wherein when the lock member is rotated by being pressed by the engagement member, a rotation moment acting on the lock member by the biasing member is switched from a second direction of pushing the engagement member to a first direction of pulling the engagement member toward the locking position, and wherein the lock member sandwiches the engagement member at a first timing earlier than a second timing at which the rotation moment is switched from the second direction to the first direction.

Further features of the present invention will become apparent from the following description of exemplary embodiments with reference to the attached drawings.

DESCRIPTION OF THE EMBODIMENTS

Hereinafter, embodiments of the present invention will be described in detail with reference to the drawings.

First Embodiment

Figure 1A:
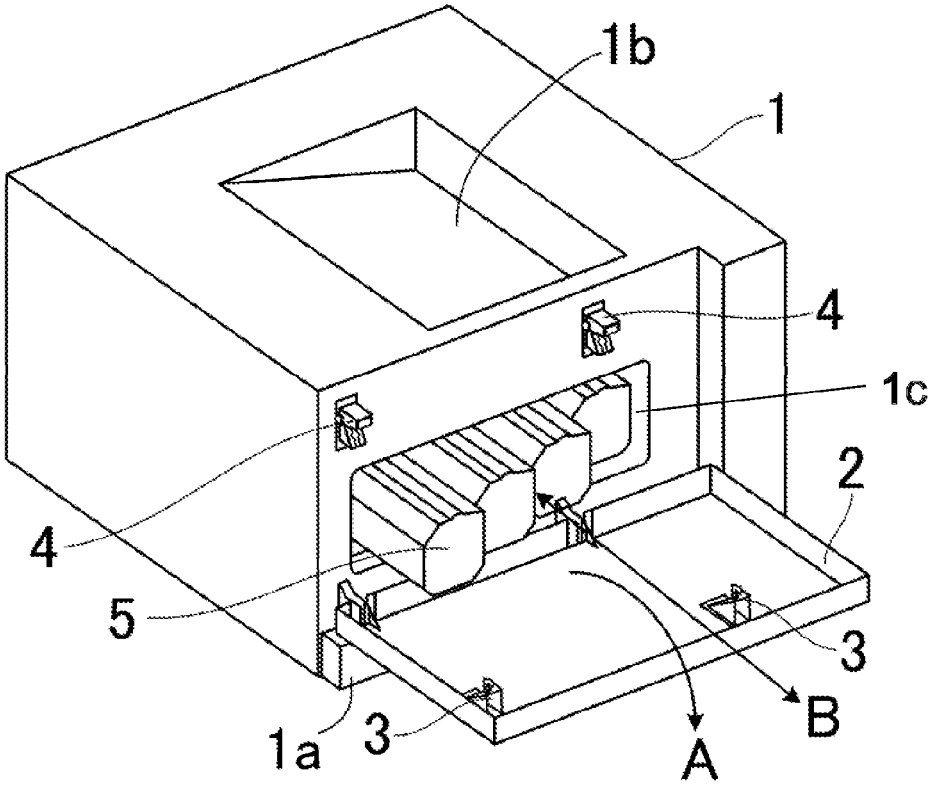
FIGS. 1A and 1B are schematic perspective views illustrating an image forming apparatus.
Figure 1B:
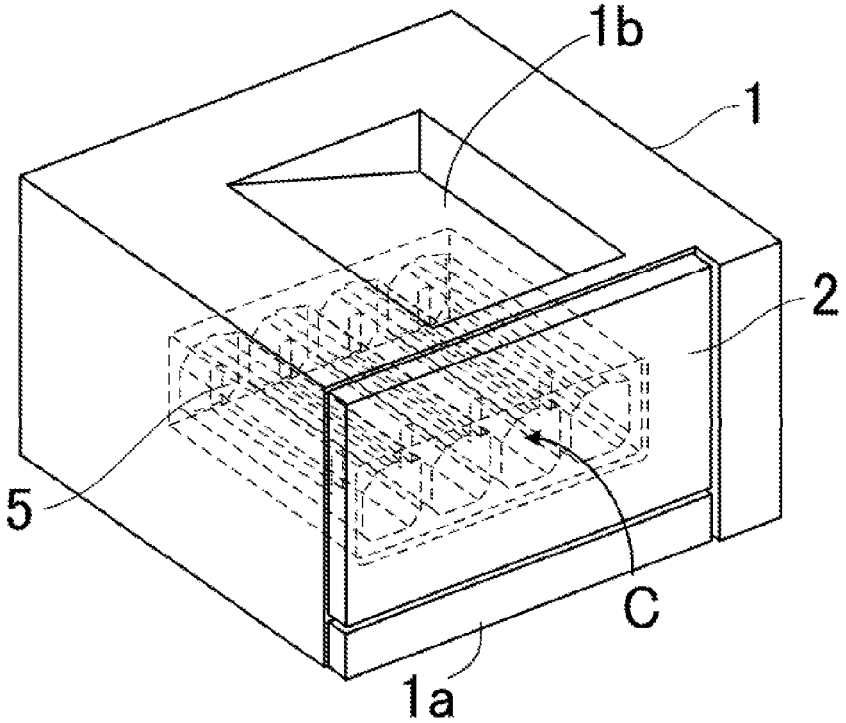

FIGS. 1A and 1B illustrate an image forming apparatus to which a lock mechanism according to a first embodiment is applied.

The image forming apparatus of the illustrated example is a laser beam printer which uses an electrophotographic process and in which a front cover 2 as an opening/closing member is supported so as to be rotatable in the direction indicated by an arrow A relative to an apparatus body 1 as a main body of the image forming apparatus. The front cover 2 is configured to open and close an opening 1*c* formed in the apparatus body 1, and in this embodiment, the opening 1*c* is an opening for attaching and detaching a process cartridge 5 relative to the apparatus body 1 in the direction indicated by an arrow B.

Figure 10:
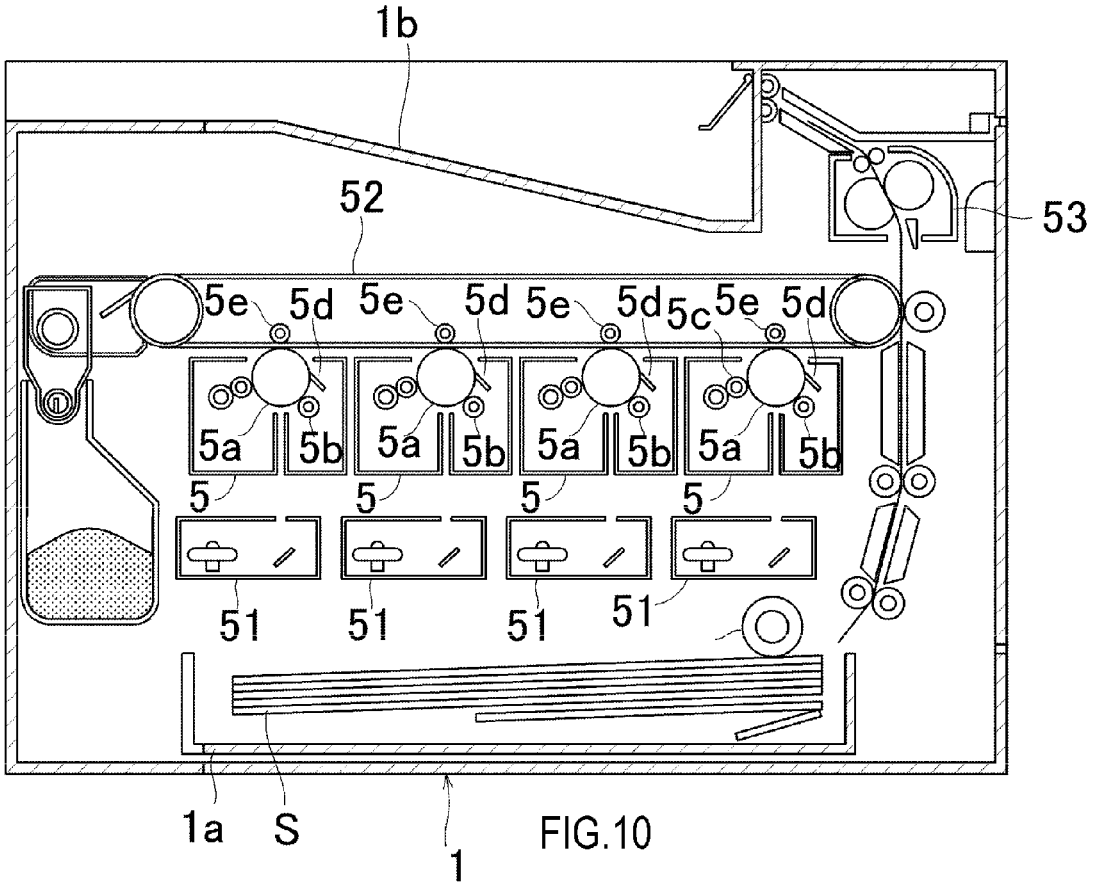
FIG. 10 is a diagram illustrating an example of an inner configuration of the image forming apparatus illustrated in FIGS. 1A and 1B.

As illustrated in FIG. 10, the process cartridge 5 is, for example, a cartridge, in which process means for executing an electrophotographic process, including charging means such as a charging roller 5*b*, developing means such as a developing roller 5*c*, and cleaning means such as a cleaning member 5*d*, are integrally provided around a photosensitive drum 5*a*, and which is configured to be detachably attached to the apparatus body 1.

In each process cartridge 5, the surface of the photosensitive drum 5*a* charged by the charging roller 5*b* is irradiated with light corresponding to image information by a laser exposure apparatus 51. After that, toner is supplied to the surface of the photosensitive drum 5*a* by the developing roller 5*c* and a toner image is formed on the surface of the photosensitive drum 5*a*.

The toner image formed on each photosensitive drum 5*a* is transferred to an intermediate transfer belt 52 by a transfer roller 5*e*. The toner image superimposed on the intermediate transfer belt 52 is transferred to a recording material S conveyed from a sheet feed cassette 1*a*. After that, the toner image transferred to the recording material S is fixed by a fixing apparatus 53, and the fixed recording material S is discharged to a sheet discharge tray 1*b* provided on an upper surface of the apparatus.

As illustrated in FIG. 1A, a lock portion (a lock mechanism) 4 that locks the front cover 2 is provided in the apparatus body 1. The lock portion 4 has a toggle mechanism. An engagement member 3 that engages with the lock portion 4 is provided on the front cover 2 that can be opened and closed relative to the apparatus body 1. A pair of left and right engagement members 3 is provided near an upper edge of the rear surface of the front cover 2, and a pair of left and right lock portions 4 is provided on a wall surface above the opening 1*c*, of the front surface of the apparatus body 1.

As illustrated in FIG. 1B, when the front cover 2 is rotated in the direction (the closing direction of the front cover 2) indicated by an arrow C, the front cover 2 is closed, and at this position of cover closure illustrated in the drawing, the engagement member 3 is locked by the lock portion 4. Moreover, the process cartridge 5 is attached to a predetermined position inside the apparatus body 1 and image formation can be performed.

Figure 2A:
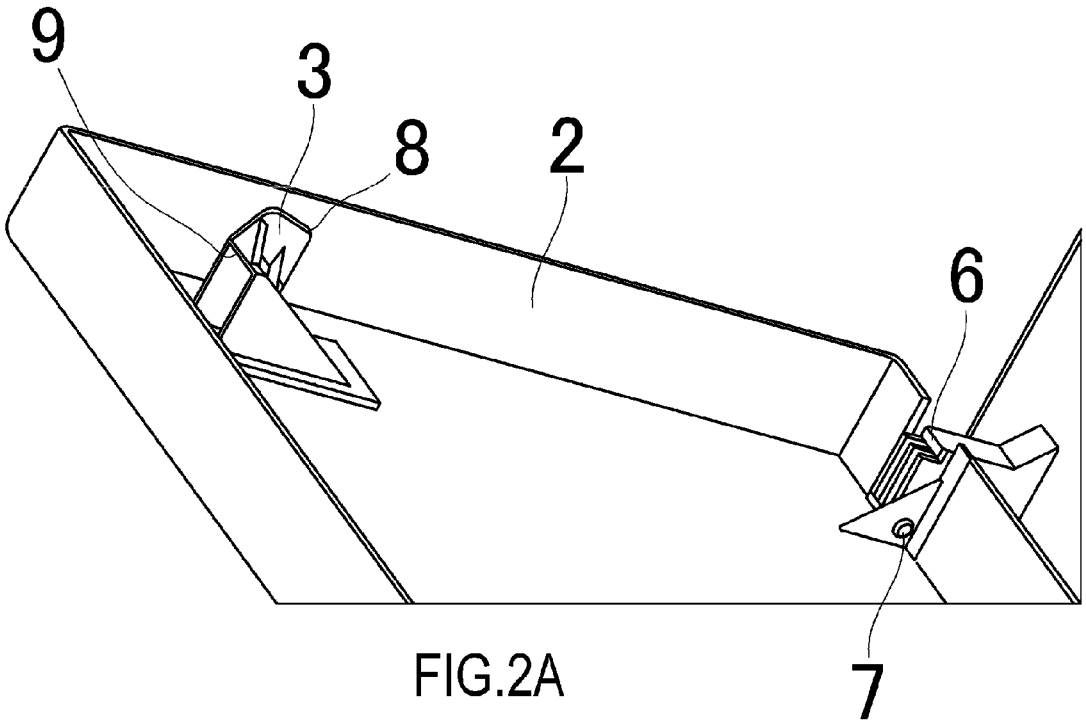
FIG. 2A is a schematic diagram of a front cover rotating portion and FIG. 2B is a detailed perspective view of an engagement member in FIGS. 1A and 1B.

FIG. 2A is a schematic diagram illustrating a rotating portion of the front cover 2.

A cover holding portion 6 that rotatably supports the front cover 2 is fixed to a lower portion of the apparatus body 1, and a cover rotation shaft 7 which is the center of rotation of the front cover 2 is formed integrally with the cover holding portion 6.

Figure 2B:
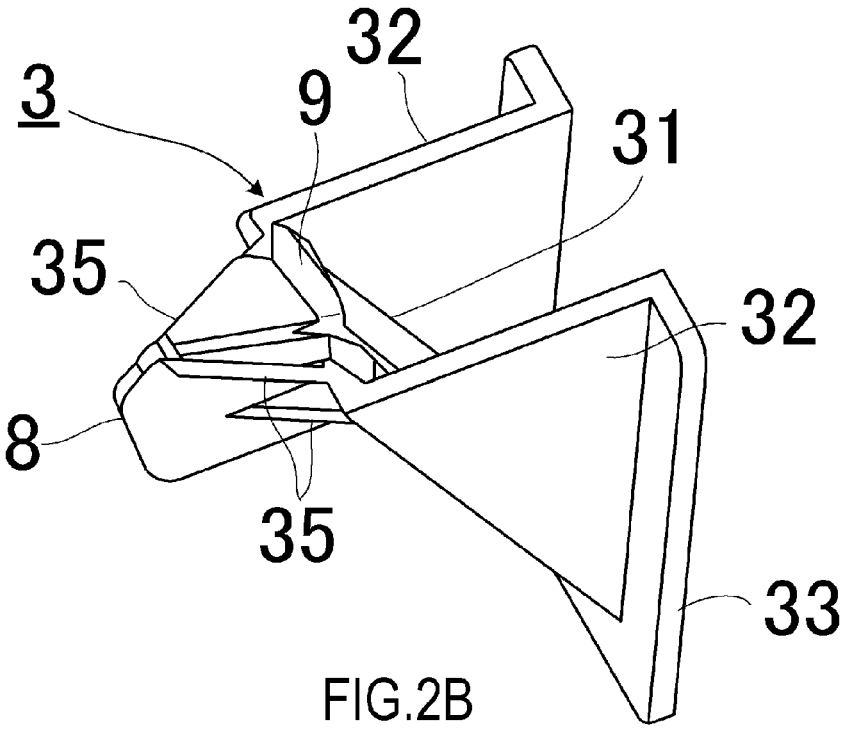

FIG. 2B is a detailed view of the engagement member 3 fixed to the rear surface of the front cover 2.

The engagement member 3 has such a shape that an upper end is open in a U-shaped in a cross-section and includes a front plate portion 31, a pair of side plate portions 32, and fixed plate portions 33 protruding outward at a right angle from the side plate portions 32. The front plate portion 31 is configured to protrude obliquely frontward from the rear surface of the front cover 2 as it advances upward from the lower end in a state where the front cover 2 is closed, and the side plate portions 32 have a triangular shape. On the other hand, the fixed plate portion 33 is provided so as to surround the lower end of the front plate portion 31 and both side edges of the side plate portions 32 in a U-shape.

A projection 8 as a pressing portion that protrudes frontward toward the apparatus body 1 is provided on the front surface of the front plate portion 31.

Moreover, a plurality of reinforcing pieces 35 for supporting the projection 8 are provided at an intermediate position and the upper end of both side surfaces of the projection 8. The reinforcing piece 35 is a piece of a triangular shape that is fixed over the side surface of the projection 8 as well as the front plate portion 31 and protrudes at a right angle from both side surfaces of the projection 8.

On the other hand, a locked portion 9 with which a distal end of a toggle lever 11 (FIG. 3A) makes contact is provided near an upper end of the rear surface of the front plate portion 31 on the opposite side from the projection 8. The locked portion 9 is one step higher than a lower portion of the back surface of the front plate portion 31.

Next, the lock portion 4 will be described.

Figure 3A:
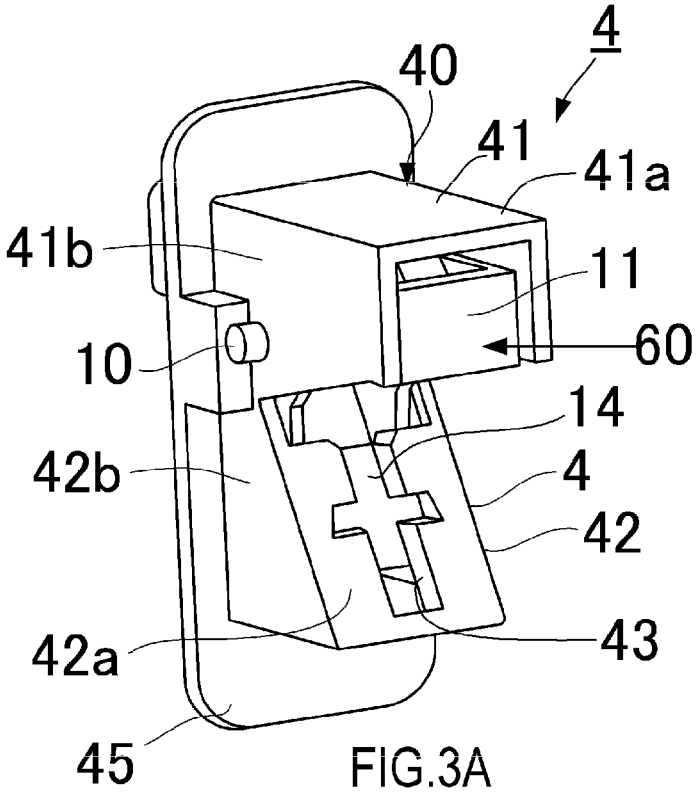
FIGS. 3A and 3B are schematic perspective views of a lock mechanism illustrated in FIGS. 1A and 1B when seen from a different direction.
Figure 3B:
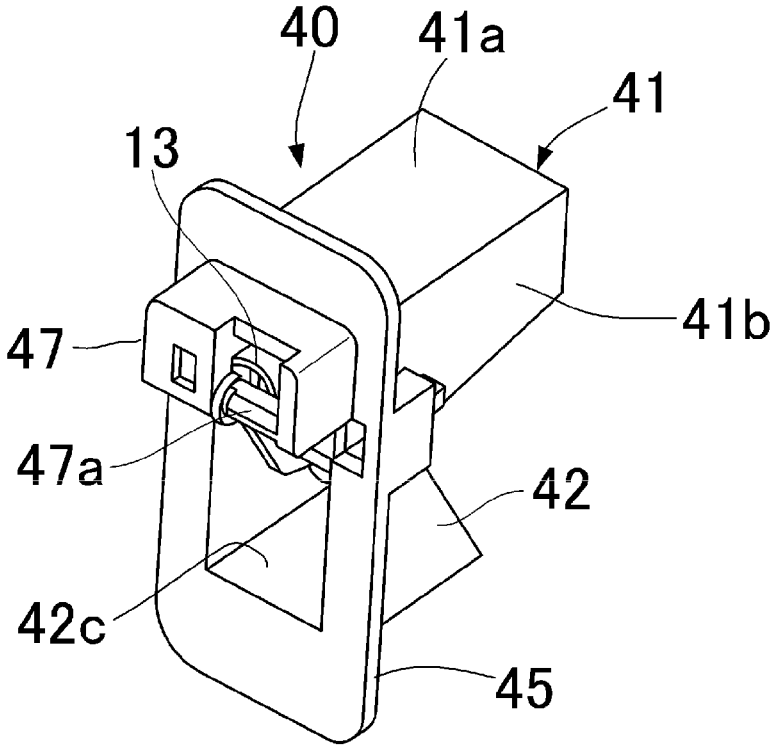

FIGS. 3A and 3B illustrate an appearance of the lock portion 4, in which FIG. 3A is a perspective view when seen from the front side (the side facing the front cover 2) and FIG. 3B is a perspective view when seen from the rear side.

The lock portion 4 is configured to include a toggle holder 40, and in the toggle holder 40, a lock member 60 having a lever structure that is held so as to freely swing about a first shaft 10 and a toggle spring 13 as a biasing member that rotatably biases the lock member 60.

The toggle holder 40 includes a hollow upper box portion 41 in which the toggle lever (a second portion) 11 is accommodated and a hollow lower box portion 42 in which the toggle base (a first portion) 14 is accommodated. The upper box portion 41 has such a U-shaped cross-section of which the lower surface side is open and includes an upper plate portion 41*a* and a pair of side plate portions 41*b*. The ends of the first shaft 10 are supported by the side plate portions 41*b*.

The lower box portion 42 includes a restricting plate portion 42*a* with which a base plate 14*b* (FIG. 4A) of the toggle base 14 makes contact, side plate portions 42*b* that connect side edges of the restricting plate portion 42*a* and a fixed plate portion 45, and a bottom plate portion 42*c* that connects a bottom edge of the restricting plate portion 42*a* and the fixed plate portion 45.

A notch portion 43 through which the projection 8 of the engagement member 3 and the reinforcing piece 35 can pass is formed in the restricting plate portion 42*a*. An upper portion of the notch portion 43 is connected to an open space of the upper box portion 41.

Moreover, a rear box portion 47 that protrudes rearward is provided on the rear surface of the fixed plate portion 45 at a position corresponding to the upper box portion 41, and a spring hook portion 47*a* with which an end of the toggle spring 13 engages is provided in the rear box portion 47. Although not illustrated particularly, a hole or a depression for avoiding interference with the rear box portion 47 is formed in the apparatus body 1.

Figure 4A:
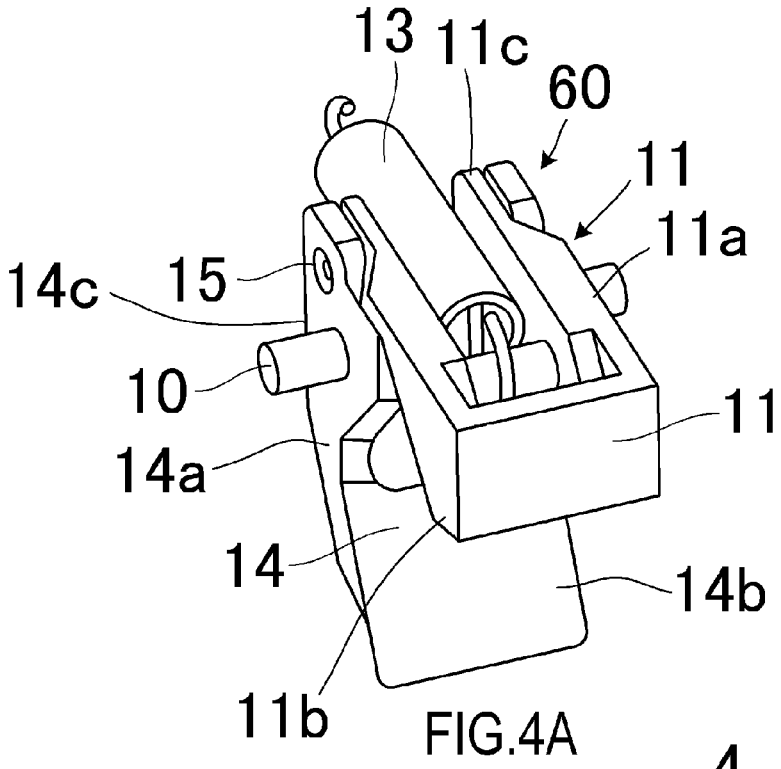
FIG. 4A is a perspective view of a lock member.
Figure 4B:
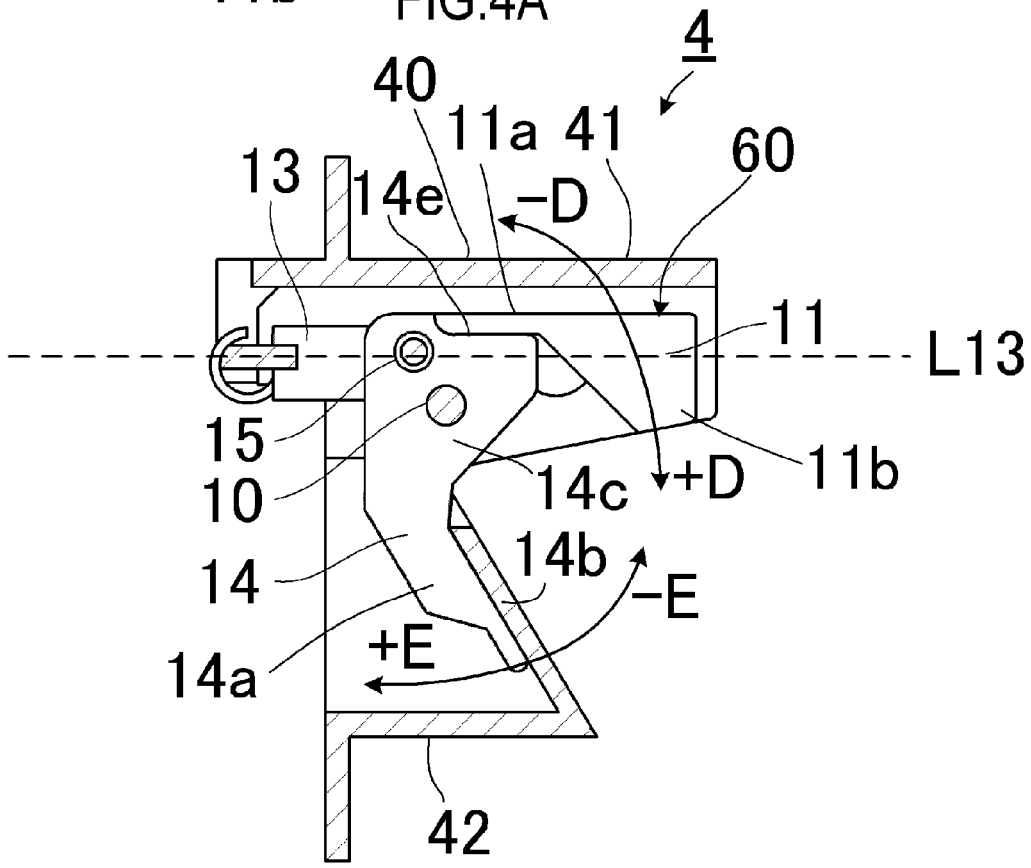
FIG. 4B is a view illustrating the lock member at a standby position.

Next, the lock member 60 will be described in detail with reference to FIGS. 4A and 4B and FIGS. 5A to 5D. FIG. 4A is a perspective view illustrating an appearance of the lock member 60, FIG. 4B is a cross-sectional view illustrating a state in which the lock member 60 is incorporated into the toggle holder 40, and FIGS. 5A to 5D illustrate the operation of the lock member 60.

As illustrated in FIG. 4A, the lock member 60 is an L-shaped member obtained by combining the toggle lever 11 as a pulling portion (a second portion) extending in an approximately orthogonal direction from the first shaft 10 and the toggle base 14 as an operating portion (a first portion). The toggle base 14 is provided so as to freely swing about the first shaft 10 and is rotated and moved by being pressed by the projection 8 of the engagement member 3 during a closing operation of the front cover 2.

On the other hand, the toggle lever 11 is assembled so as to freely swing about a second shaft 15 relative to the toggle base 14. When the toggle base 14 rotates about the shaft 10, the toggle lever 11 also rotates integrally with the toggle base 14. When the toggle lever 11 makes contact with the locked portion 9 provided in the engagement member 3 and the engagement member 3 is pulled to the lock position, the front cover 2 as an opening/closing member is locked. As described above, the lock member 60 includes the toggle base (the first portion) 14 pressed by the engagement member 3 and the toggle lever (the second portion) 11 that sandwiches the engagement member 3 together with the toggle base 14 by making contact with the engagement member 3. Moreover, a relative positional relation between the toggle base 14 and the toggle lever 11 is variable.

The toggle spring (a biasing member) 13 has one end caught at the spring hook portion 47*a* and the other end caught at a latch portion 11*b*. The toggle spring 13 is a tension coil spring, which rotationally biases the lock member 60 toward a standby position Pa (−E direction) when the lock member 60 is between the standby position Pa of the lock member 60 and a neutral point Pb of the toggle mechanism, which is a predetermined swing phase. When the lock member 60 passes the neutral point Pb, the rotational biasing direction is switched to a locking position Pc (+E direction). That is, when the lock member 60 rotates by being pressed by the engagement member 3, a rotation moment acting on the lock member 60 by the biasing member 13 is switched from a second direction (−E direction) of pushing the engagement member 3 to a first direction (+E direction) of pulling the engagement member 3 toward the locking position. Moreover, the toggle lever 11 and the toggle base 14 of the lock member 60 elastically sandwiches the projection 8 of the engagement member 3 and the locked portion 9 at a timing earlier than a timing at which the lock member 60 is at the neutral point Pb. That is, the lock member 60 sandwiches the engagement member 3 at a first timing earlier than the neutral point Pb (a second timing) at which the rotation moment is switched from the second direction (−E direction) to the first direction (+E direction). The operation of the lock member 60 will be described in detail later.

In this embodiment, when the toggle lever 11 of the lock member 60 makes contact with the locked portion 9 of the engagement member 3, the toggle lever 11 elastically bends in the −D direction relative to the toggle base 14 about the second shaft 15. As described above, the toggle spring 13 has one end caught at the spring hook portion 47*a* and the other end caught at the latch portion 11*b*. Thus, the biasing force of the toggle spring 13 acts on the toggle lever 11, and the engagement member 3 (that is, the front cover 2) can move to the locking position Pc while maintaining the contact state between the toggle base 14 and the projection 8 and the contact state between the toggle lever 11 and the locked portion 9.

Hereinafter, the configuration of the toggle lever 11 and the toggle base 14 will be described in more detail.

Since a stopper portion 14*e* formed on the toggle base 14 is disposed in the direction (+D direction) approaching the toggle base 14, the toggle lever 11 cannot further bend and this state is an initial state. Even when the front cover 2 is moved in a locking direction (the direction F=the direction C illustrated in FIG. 1B) in a state (the state illustrated in FIG. 5B and the subsequent states) in which the engagement member 3 is sandwiched between the toggle lever 11 and the toggle base 14, the toggle spring 13 biases the toggle lever 11 so as to maintain a state (the initial state) in which the toggle lever 11 makes contact with the stopper portion 14*e*.

The biasing force will be described. The second shaft 15 is offset in one side relative to a straight line L13 that connects both ends of the toggle spring 13 in an entire range from the standby position Pa to the locking position Pc. With this offset, the biasing force of the toggle spring 13 generates a moment in a direction (+D direction) in which the toggle lever 11 makes pressure-contact with the stopper portion 14*e*. That is, a moment is generated in the direction of bringing the toggle lever 11 into pressure-contact with the stopper portion 14*e* by the coupling of the biasing force of the toggle spring 13 acting on the toggle lever 11 and the reaction force acting on the second shaft 15. As a result, the toggle lever 11 and the toggle base 14 rotate integrally.

Next, the configuration of respective members of the lock member 60 will be described in more detail.

The toggle base 14 has a pair of arm plates 14*a* extending in an up-down direction in parallel and the base plate 14*b* that connects the lower portions of the front edges of the arm plates 14*a*.

The arm plate 14*a* has a base portion 14*c* through which the first shaft 10 and the second shaft 15 provided in the toggle lever 11 pass.

The stopper portion 14*e* with which the toggle lever 11 makes contact is formed on the upper end of the base portion 14*c* of the arm plate 14*a*.

The second shaft 15 is offset upward relative to the first shaft 10 by a predetermined distance. In this example, the first shaft 10 is located approximately at the center of the base portion 14*c*, and the second shaft 15 is located at a position near a corner of the upper rear end of the base portion 14*c* and on the upper rear side (the apparatus body side) relative to the first shaft 10.

On the other hand, the toggle lever 11 includes a pair of arm plates 11*a* extending in a horizontal direction in parallel, the latch portion 11*b* provided in a front end of the arm plate 11*a*, and a base portion 11*c* provided in a rear end of the arm plate 11*a*. The latch portion 11*b* makes contact with the locked portion 9 of the engagement member 3. The arm plate 11*a* of the toggle lever 11 makes contact with the stopper portion 14*e* on the upper end of the base portion 14*c* of the toggle base 14. Moreover, a spring hook portion at which one end of the toggle spring 13 is caught is provided in the latch portion 11*b*.

Next, the operation of the lock mechanism will be described with reference to FIGS. 5A to 5D.

Figure 5A:
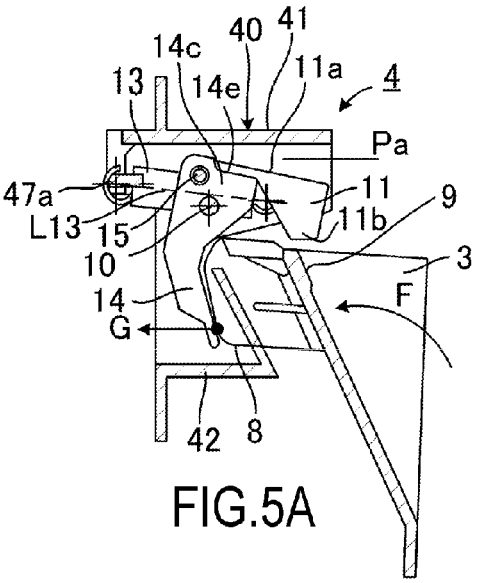
FIGS. 5A to 5D are diagrams for describing the operation of the lock member.

As illustrated in FIG. 5A, with a closing operation of the front cover 2 (see FIG. 1A), the projection 8 provided on the front end of the engagement member 3 enters the notch portion 43 (see FIG. 3A) along a trajectory indicated by an arrow F, and the base plate 14*b* of the toggle base 14 is pressed in a direction indicated by an arrow G by the projection 8. With this pressing operation, the toggle base 14 starts rotating in the direction indicated by an arrow +E (see FIG. 4B) about the first shaft 10.

With rotation of the toggle base 14, the toggle lever 11 supported on the toggle base 14 by the second shaft 15 also rotates integrally with the toggle base 14. As a result, the toggle spring 13 follows the movement of the toggle lever 11 while changing an operating length and an attitude. In the state illustrated in FIG. 5A, the toggle lever 11 is not in contact with the engagement member 3. That is, the lock member 60 does not sandwich the engagement member 3.

Figure 5B:
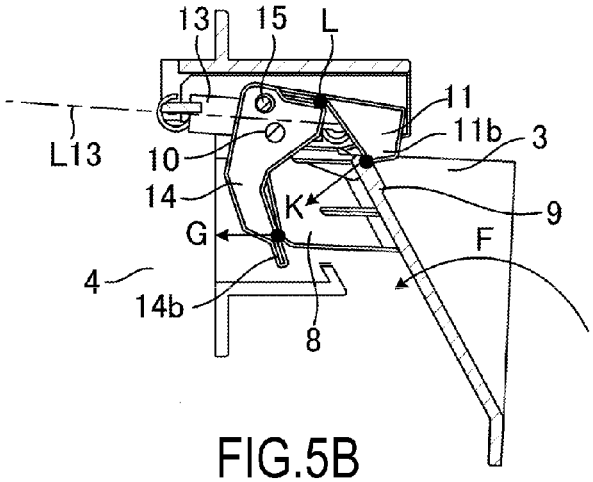

FIG. 5B illustrates a timing (the first timing) before the phase of the lock member 60 reaches the neutral point Pb of the toggle mechanism. At this timing, the toggle base 14 and the projection 8 are in contact with each other and the toggle lever 11 and the engagement member 3 are in contact with each other. That is, FIG. 5B illustrates a state immediately after a state in which the lock member 60 sandwiches the engagement member 3 with the toggle base 14 and the toggle lever 11 is created.

In the rotation phase illustrated in FIGS. 4B, 5A, and 5B, the straight line L13 that connects both ends of the toggle spring 13 is on the upper side than the first shaft 10 in the drawing. In such a phase, the rotation moment acting on the lock member 60 due to the biasing force of the toggle spring 13 is in the −E direction (the second direction). Moreover, in the state of FIG. 5B, a gap L is formed between the toggle base 14 and the toggle lever 11. Thus, this relative positional relation exhibits a wider gap than that in the relative positional relation between the toggle base (the first portion) 14 and the toggle lever (the second portion) 11 illustrated in FIG. 5A.

Figure 5C:
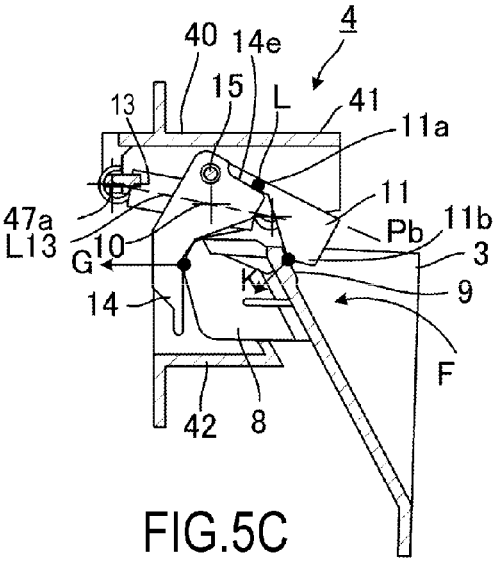

FIG. 5C is a diagram illustrating a state in which the phase of the toggle mechanism of the lock member 60 is near the neutral point Pb.

As illustrated in FIG. 5C, in a phase illustrated in FIG. 5C in which the straight line L13 connecting both ends of the toggle spring 13 overlaps the center of the first shaft 10, a rotation moment caused by the biasing force of the toggle spring 13 does not act on the lock member 60. That is, this state (the second timing) is the neutral point Pb of the toggle mechanism. Before this phase (the second timing) occurs (in a period in which the rotation moment acting on the lock member 60 due to the biasing force of the toggle spring 13 is in the direction indicated by the arrow −E) (that is, at the timing (the first timing) illustrated in FIG. 5B), the toggle lever 11 is already in contact with the locked portion 9 of the engagement member 3. After the phase of the neutral point Pb illustrated in FIG. 5C occurs, the toggle lever 11 presses the locked portion 9 of the engagement member 3 in the direction indicated by an arrow K due to the biasing force of the toggle spring 13 and the engagement member 3 is pulled toward the apparatus body 1.

At the same time, the toggle lever 11 bends (rotates about the second shaft 15) relative to the toggle base 14, and the arm plate 11*a* of the toggle lever 11 is separated from the stopper portion 14*e* of the base portion 14*c* of the toggle base 14 and the gap L is formed. This is an engagement backlash occurring inside the lock member 60, and this gap L is also formed in a phase near the neutral point Pb.

Figure 5D:
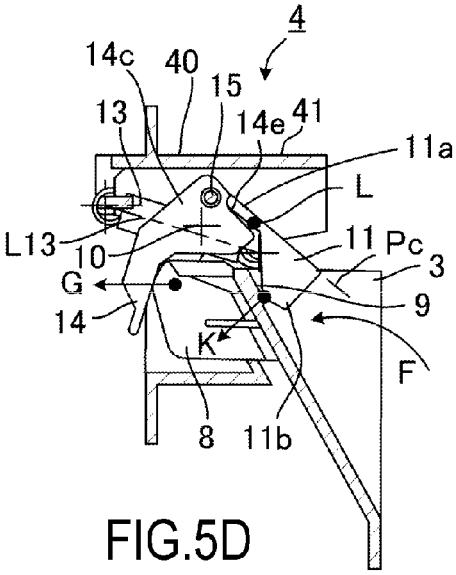

FIG. 5D is a diagram illustrating a state in which the phase of the toggle mechanism of the lock member 60 has passed the neutral point. In the locking position Pc illustrated in FIG. 5D, the straight line L13 connecting both ends of the toggle spring 13 is on the lower side than the first shaft 10 in the drawing. In this locking position Pc, the rotation moment acting on the lock member 60 due to the biasing force of the toggle spring 13 is in the +E direction (the first direction). As illustrated in FIG. 5D, the straight line L13 of the toggle spring 13 passes the center of the first shaft 10 of the toggle base 14 and a rotating force is generated in a direction of pulling the engagement member 3.

In this case, the gap L is kept intact, and at the same time, the projection 8 of the engagement member 3 is in contact of the toggle base 14 and the locked portion 9 is in contact with the latch portion 11*b* of the toggle lever 11. That is, a state in which the engagement member 3 is pressed and sandwiched in a front-rear direction by the toggle base 14 and the toggle lever 11 is created. The front cover 2 (the engagement member 3) can rotate up to the lock state while maintaining the sandwiching state. This pressing and sandwiching is realized by the toggle base 14 being biased together with the toggle lever 11 about the first shaft 10 and the biasing force acting on the second shaft 15 before and after the neutral point.

Figure 9A:
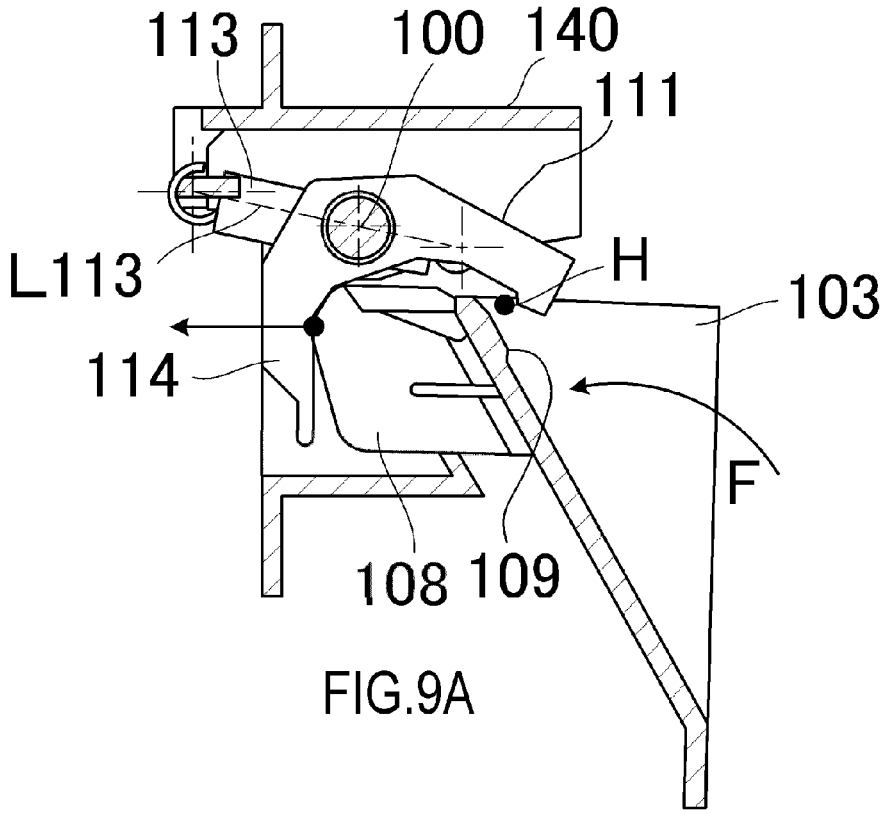
FIGS. 9A and 9B are diagrams for describing the operation of a lock member according to a comparative example.
Figure 9B:
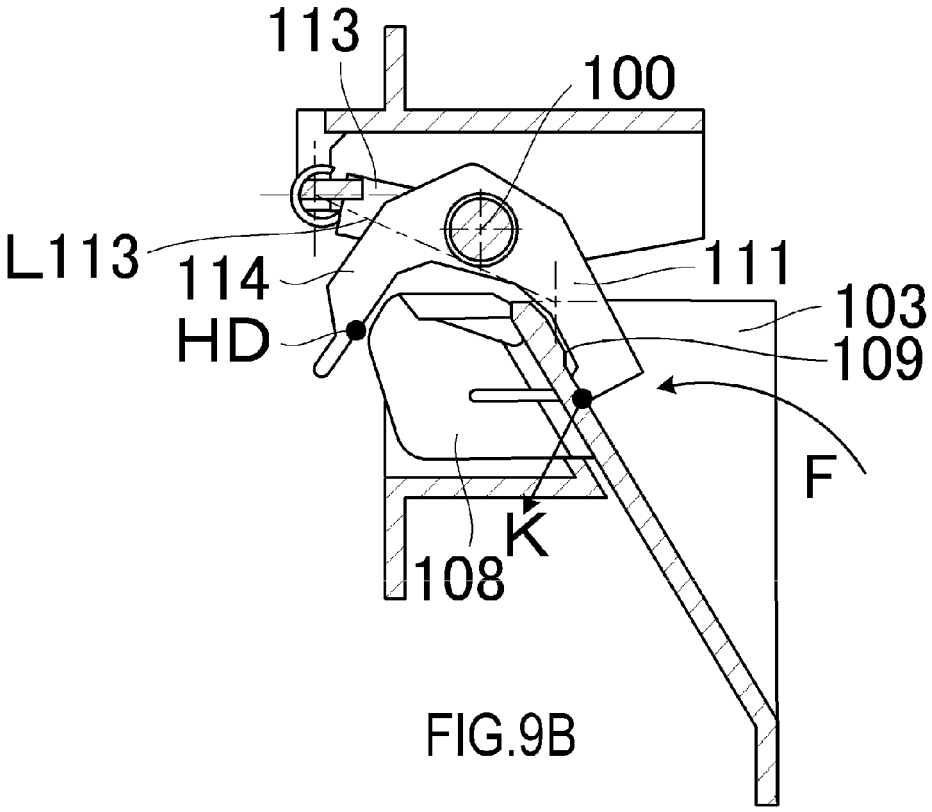

FIGS. 9A and 9B illustrate an example (a comparative example) of a lock member when such sandwiching means as in the present embodiment is not present. In the comparative example, a toggle base 114 and a toggle lever 111 are configured as a single component and a relative positional relation of the toggle base 114 and the toggle lever 111 is always constant. The toggle base 114 is provided so as to be rotatable about a shaft 100 relative to a toggle holder 140.

As illustrated in FIG. 9A, an engagement backlash (a gap) H is present between the toggle lever 111 and a locked portion 109 of an engagement member 103 at a neutral point (a phase in which a straight line L113 connecting both ends of a toggle spring 113 overlaps the center of the shaft 100) of the toggle mechanism. This is a backlash necessary for components to perform a swing operation reliably without any interference with each other. In this state, a projection 108 makes contact with the toggle base 114 and the projection 108 presses the toggle base 114.

When the toggle lever 111 (the toggle base 114) passes the neutral point of the toggle mechanism, the toggle lever 111 (the toggle base 114) rotates abruptly due to a rotation moment of the toggle spring 113. With this rotation, the toggle lever 111 and the locked portion 109 make contact with each other and the toggle base 114 and the projection 108 are separated from each other. When the toggle lever 111 (the toggle base 114) rotates abruptly and the toggle lever 111 makes contact with the engagement member 103, a collision sound is generated.

In a state (the state illustrated in FIG. 9B) in which the toggle lever 111 (the toggle base 114) passes the neutral point of the toggle mechanism and the engagement member 103 is locked, the engagement backlash H between the toggle lever 111 and the locked portion 109 of the engagement member 103 is eliminated, and another engagement backlash (a gap) HD is formed between the toggle base 114 and the projection 108. The toggle lever 111 biases the engagement member 103 in the direction indicated by an arrow K due to the biasing force of the toggle spring 113.

In contrast, in the present embodiment, a state in which the engagement member 3 is pressed and sandwiched by the toggle base 14 and the toggle lever 11 is created at the first timing before the lock member 60 reaches the phase of the neutral point Pb of the toggle mechanism. Moreover, since the engagement member 3 is already sandwiched by the lock member 60 when the lock member 60 exceeds the phase of the neutral point Pb of the toggle mechanism, it is possible to prevent generation of the collision sound.

Figure 6:
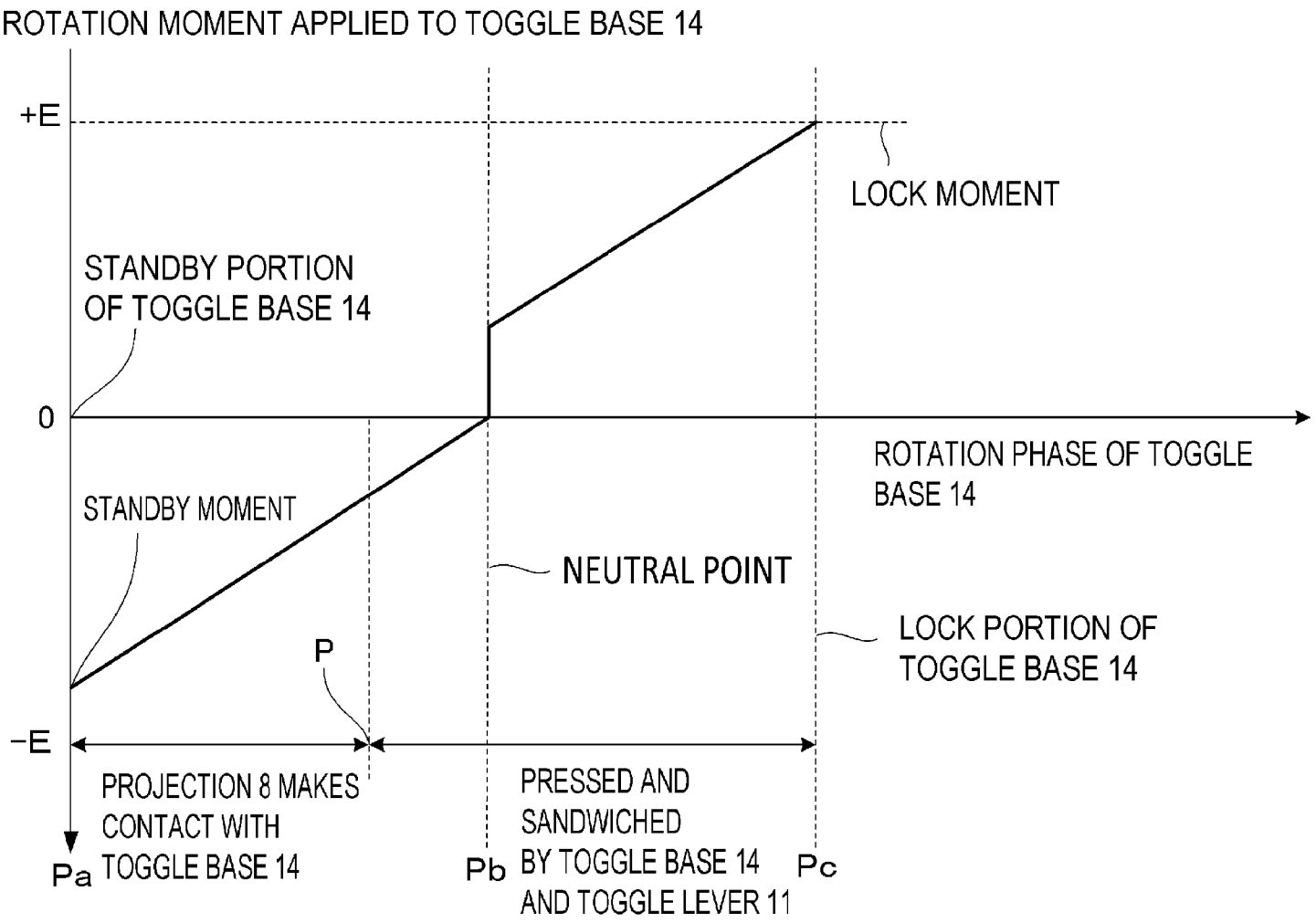
FIG. 6 is a schematic view illustrating a correlation between a rotation phase and a rotation moment of the lock member.
Figure 7A:
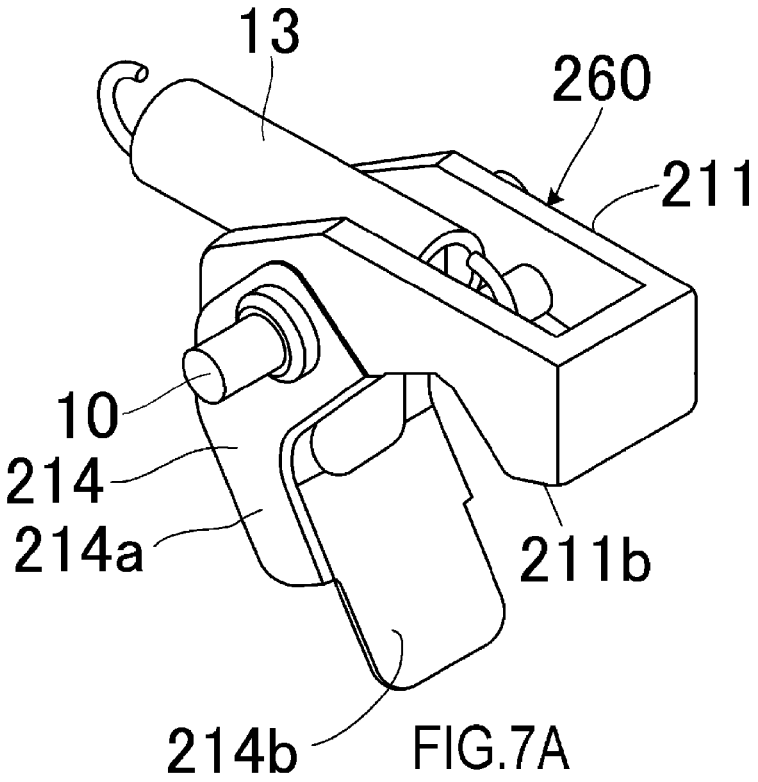
FIG. 7A is a perspective view of a lock member according to a second embodiment.
Figure 7B:
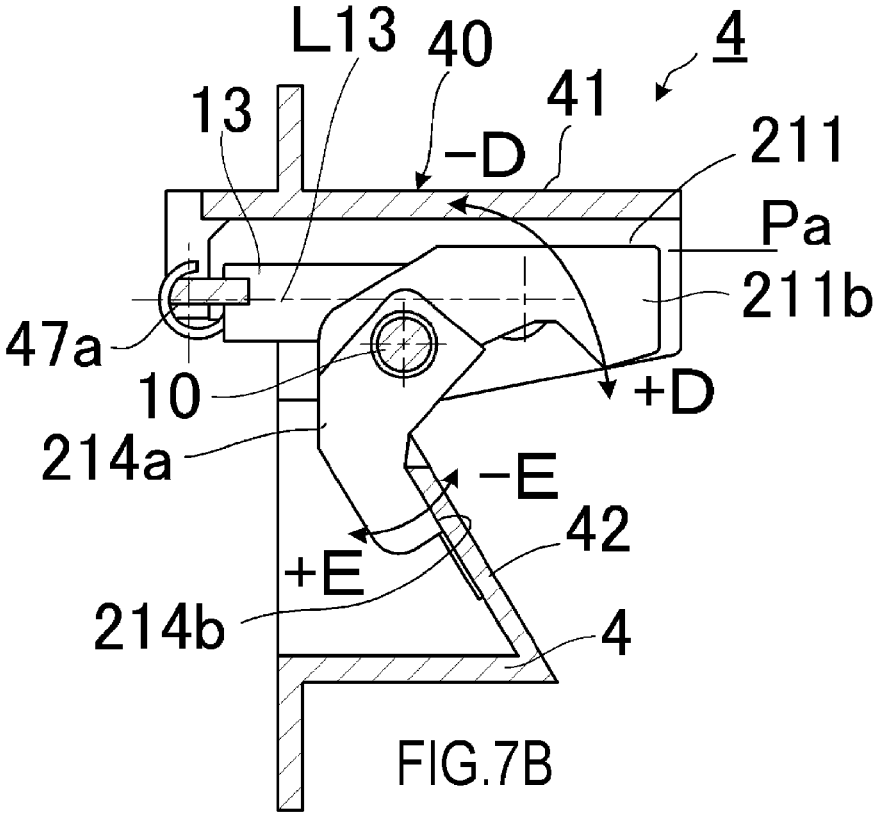
FIG. 7B is a view of the lock member before operation.

FIG. 6 is a schematic diagram illustrating a relation between rotation moment (that is, the rotation moment acting on the lock member 60) acting on the toggle base 14 and a rotation phase of the toggle lever 11 and the toggle base 14.

With the entrance of the engagement member 3, the rotation moment of the toggle base 14 at the standby position gradually decreases from minus to zero. In this case, the toggle base 14 and the engagement member 3 are in such a contact state as illustrated in FIG. 5A.

After that, in a rotation phase P before the rotation phase of the toggle base 14 reaches the neutral point Pb, the toggle lever 11 starts making contact with the locked portion 9 of the engagement member 3. In this case, a state of contact among the toggle lever 11, the toggle base 14, and the engagement member 3 is a pressing and sandwiching contact state as illustrated in FIG. 5B.

Further, the toggle lever 11, the toggle base 14, and the engagement member 3 reach the neutral point Pb while maintaining the state in which the engagement member 3 is pressed and sandwiched (see FIG. 5C), and after that, the toggle lever 11, the toggle base 14, and the engagement member 3 exceed the neutral point Pb to proceed to a lock state. In this case, the toggle lever 11, the toggle base 14, and the engagement member 3 are in such a state as illustrated in FIG. 5D.

As illustrated in the schematic diagram, before the phase of the neutral point Pb at which an abrupt change occurs in the rotation moment occurs, a state in which the toggle lever 11 and the toggle base 14 press and sandwich the engagement member 3 is created, and the collision sound is not generated when the phase passes the neutral point Pb.

As described above, in the present embodiment, at a timing before the phase of the toggle base 14 reaches the neutral point Pb of the toggle mechanism, the engagement member 3 is pressed and sandwiched by the lock member 60. Thus, an engagement backlash when the phase passes the neutral point Pb does not occur. Therefore, collision sound, deriving from abrupt elimination of the engagement backlash described in the comparative example, is not generated, and the collision sound can be eliminated without impairing usability.

In the first embodiment, although a configuration in which the toggle lever 11 is rotationally biased in a direction of making contact with the stopper portion 14*e* of the toggle base 14 by the biasing force of the toggle spring 13 has been described, the present invention is not limited to this configuration. For example, a torsion coil spring may be attached around the second shaft 15 so as to apply rotational biasing force, and other biasing means may be used.

Second Embodiment

Next, a second embodiment of the present invention will be described with reference to FIGS. 7A and 7B and FIGS. 8A and 8B.

The second embodiment has the same configuration as the first embodiment except that the lock member is modified as a lock member 260. Thus, in the drawings, constituent elements substantially the same as those of the first embodiment will denoted by the same reference numerals as those of the first embodiment, and the detailed description thereof will not be provided.

In the second embodiment, a pulling portion 211 (the second portion) and an operating portion 214 (the first portion) that form the lock member 260 are integrated with each other. Thus, a relative positional relation between the pulling portion 211 and the operating portion 214 is always constant. However, a portion (an elastic plate 214*b*) of the engagement member 3 making contact with the projection 8 is formed of an elastic member. Thus, the lock member 260 can sandwich the engagement member 3 at the first timing before the phase of the lock member 260 reaches the neutral point of the toggle mechanism.

The lock member 260 is an L-shaped member in which the pulling portion 211 extending in an approximately orthogonal direction from the first shaft 10 and the operating portion 214 are integrally fixed. The operating portion 214 is rotated and moved by being pressed by the projection 8 of the engagement member 3 during the closing operation of the front cover 2. With rotation of the operating portion 214, the pulling portion 211 is rotated and moved from a standby position at which the pulling portion 211 is separated from the locked portion 9 of the engagement member 3 to a locking position at which the pulling portion 211 makes contact with the locked portion 9.

The toggle spring 13 biases the lock member 260 toward a standby position (−E direction) when the lock member 260 is between the standby position of the lock member 260 and a neutral point of the toggle mechanism, which is a predetermined swing phase. When the lock member 260 passes the neutral point, the toggle spring 13 biases the lock member 260 toward the locking position (+E direction).

The operating portion 214 has a pair of arm plates 214*a* extending in an up-down direction in parallel and the thin elastic plate 214*b* that is elastically deformable and connects the lower portions of the front edges of the arm plates 214*a*. The projection 8 of the engagement member 3 makes contact with the elastic plate 214*b*. That is, the elastic plate 214*b* is an elastic portion provided in a contact portion between the operating portion 214 and the projection 8 of the engagement member 3. The elastic plate 214*b* is elastically deformed (that is, elastically bends) in the +E direction by the contact pressure when the projection 8 makes contact with the elastic plate 214*b*.

At a timing before the pulling portion 211 passes the neutral point of the toggle mechanism, the locked portion 9 and the projection 8 of the engagement member 3 are elastically sandwiched by the elastic plate 214*b* of the operating portion 214 and a latch portion 211*b* of the pulling portion 211 to maintain a contact state.

Figure 8A:
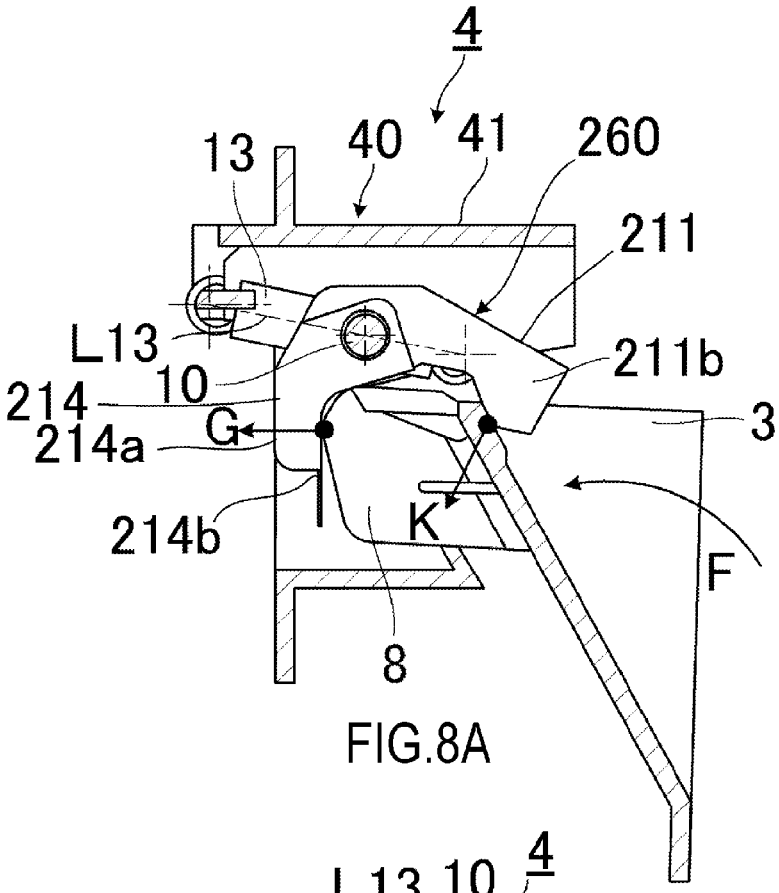
FIGS. 8A and 8B are diagrams for describing the operation of the lock member.

FIG. 8A is a diagram for describing the operation (near the neutral point) of the lock member 60.

As illustrated in FIG. 8A, in a phase illustrated in FIG. 8A in which the straight line L13 connecting both ends of the toggle spring 13 overlaps the center of the first shaft 10, a rotation moment due to a biasing force of the toggle spring 13 is not generated in the pulling portion 211.

That is, this state is the neutral point of the toggle mechanism. In this case, the pulling portion 211 is already in contact with the locked portion 9 of the engagement member 3 and presses the locked portion 9 of the engagement member 3 in the direction indicated by an arrow K by the biasing force of the toggle spring 13 to pull the engagement member 3.

On the other hand, the elastic plate 214*b* is elastically deformed by being pressed in the direction indicated by an arrow G by the projection 8 of the engagement member 3. By the elastic restoring force of the elastic plate 214*b*, the locked portion 9 and the projection 8 of the engagement member 3 are elastically pressed and sandwiched by the elastic plate 214*b* of the operating portion 214 and the latch portion 211*b* of the pulling portion 211.

Figure 8B:
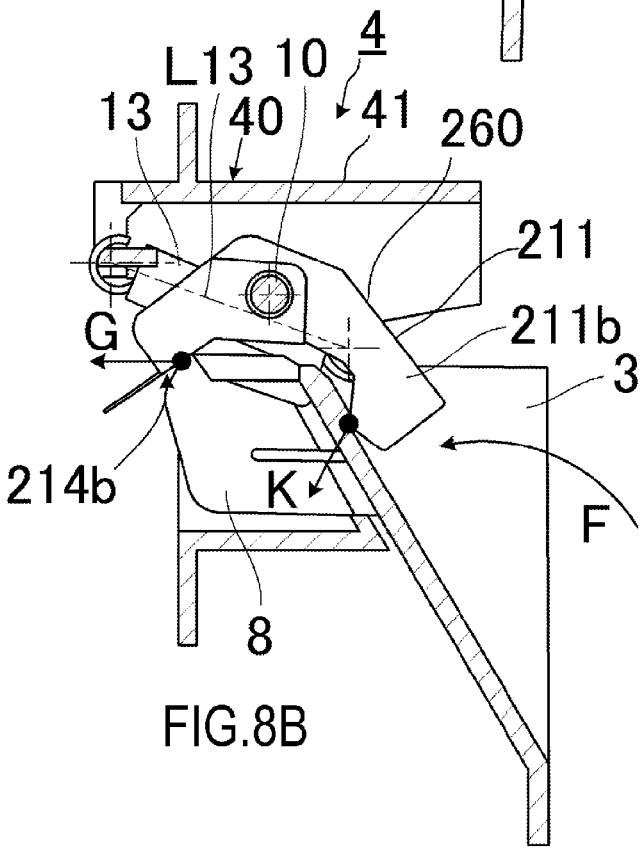

FIG. 8B is a diagram illustrating the state of the lock member 260 after the phase of the toggle mechanism passes the neutral point. In the phase illustrated in FIG. 8B, the straight line L13 connecting both ends of the toggle spring 13 is on the lower side than the first shaft 10 in the drawing. In this phase, a rotation moment generated in the lock member 260 due to the biasing force of the toggle spring 13 is in the +E direction (the first direction).

As illustrated in FIG. 8B, the straight line L13 connecting both ends of the toggle spring 13 passes the center of the first shaft 10 of the pulling portion 211 (that is, the straight line L13 moves downward to be positioned below the first shaft 10 in the drawing), and a rotating force is generated in the +D direction (see FIG. 8B) in which the pulling portion 211 pulls the engagement member 3 toward the locking position. With the elastic restoring force of the elastic plate 214*b* of the operating portion 214, the locked portion 9 and the projection 8 of the engagement member 3 maintain a state of being elastically pressed and sandwiched by the elastic plate 214*b* of the operating portion 214 and the latch portion 211*b* of the pulling portion 211 and rotate up to the locking position.

As described above, in the second embodiment, at a timing before the lock member 260 reaches the phase of the neutral point of the toggle mechanism, the lock member 260 presses and sandwiches the engagement member 3. Thus, an engagement backlash does not occur between the lock member 260 and the engagement member 3 when the lock member 260 passes the neutral point.

Thus, it is possible to eliminate collision sound due to abrupt disappearance of the engagement backlash.

In the second embodiment, although the portion of the operating portion 214 making contact with the projection 8 is formed of an elastic member, the projection 8 may be formed of an elastic member. Either the projection 8 or the portion of the operating portion 214 making contact with the projection 8 may be formed of an elastic member. Moreover, although the elastic plate 214*b* is provided in a contact portion between the operating portion 214 and the projection 8 of the engagement member 3, the elastic plate 214*b* may be provided in a contact portion between the pulling portion 211 and the locked portion 9 of the engagement member 3.

In the embodiments, although a laser printer has been described as an example of the image forming apparatus, the present invention is not limited thereto, but can be applied to various image forming apparatuses as a lock mechanism of an opening/closing member provided in an apparatus body so as to be freely opened and closed. Moreover, the present invention is not limited to an image forming apparatus but can be applied to a lock mechanism of an opening/closing member of various apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-073140, filed Mar. 31, 2015 and Japanese Patent Application No. 2016-027968, filed Feb. 17, 2016 which are hereby incorporated by reference herein in its entirety.

What is claimed is:

1. An image forming apparatus comprising:

an apparatus body;

an opening-closing member configured to be opened and closed relative to the apparatus body;

a lock mechanism, provided in the apparatus body, configured to lock the opening-closing member in a locking position, the lock mechanism including a rotatable lock member and a biasing member that biases the lock member; and an engagement member, provided in the opening-closing member, configured to engage with the lock member, wherein the lock member is rotated by being pressed by the engagement member when the opening-closing member is closed relative to the apparatus body, wherein when the lock member is rotated by being pressed by the engagement member, a rotation moment acting on the lock member by the biasing member is switched from a second direction, in which the engagement member is pushed, to a first direction, in which the engagement member is pulled toward the locking position, and wherein the lock member sandwiches the engagement member at a first timing earlier than a second timing at which the rotation moment is switched from the second direction to the first direction.

2. The image forming apparatus according to claim 1, wherein the engagement member moves to the locking position in a state of being sandwiched by the lock member.

3. The image forming apparatus according to claim 1, wherein the lock member includes a first portion pressed by the engagement member, and a second portion that sandwiches the engagement member together with the first portion by making contact with the engagement member, and a relative positional relation between the first portion and the second portion varies.

4. The image forming apparatus according to claim 3, wherein the relative positional relation between the first portion and the second portion at the first timing is wider than the relative positional relation between the first portion and the second portion when the second portion is not in contact with the engagement member.

5. The image forming apparatus according to claim 3, wherein the lock mechanism includes a holder that rotatably holds the lock member, wherein the second portion is provided so as to be movable relative to the first portion, the biasing member is a tension spring, and one end of the spring is connected to the holder and the other end of the spring is connected to the second portion.

6. The image forming apparatus according to claim 3, wherein one of the first portion and a portion of the engagement member making contact with the first portion is elastically deformable.

7. The image forming apparatus according to claim 3, wherein one of the second portion and a portion of the engagement member making contact with the second portion is elastically deformable.

8. An image forming apparatus comprising:

an apparatus body;

an opening-closing member configured to be opened and closed relative to the apparatus body;

a lock mechanism, provided in the apparatus body, configured to lock the opening-closing member in a closed position of the opening-closing member, the lock mechanism including a rotatable lock portion and a biasing member that biases the lock portion; and an engagement portion, provided in the opening-closing member, configured to engage with the lock portion, wherein the lock portion is rotated by being pressed by the engagement portion when the opening-closing member is closed relative to the apparatus body, wherein when the lock portion is rotated by being pressed by the engagement portion, a rotation moment acting on the lock portion by the biasing member is switched from a second direction, in which the engagement portion is pushed toward an opened position of the opening-closing member, to a first direction, in which the engagement portion is pushed toward the closed position of the opening-closing member, wherein the lock portion includes a first portion being contactable with the engagement portion and a second portion being contactable with the engagement portion, wherein the first portion pushes the engagement portion when the rotation moment acting on the lock portion by the biasing member is in the second direction, wherein the second portion pushes the engagement portion when the rotation moment acting on the lock portion by the biasing member is in the first direction, wherein a relative positional relation between the first portion and the second portion varies, and wherein the first and second portions sandwich the engagement portion at a first timing earlier than a second timing at which the rotation moment is switched from the second direction to the first direction.

9. The image forming apparatus according to claim 8, wherein the engagement portion moves to the closed position in a state of being sandwiched by the first and second portions.

10. The image forming apparatus according to claim 8, wherein the relative positional relation between the first portion and the second portion at the first timing is wider than the relative positional relation between the first portion and the second portion when the second portion is not in contact with the engagement portion.

11. The image forming apparatus according to claim 8, wherein the lock mechanism includes a holder that rotatably holds the lock portion, wherein the second portion is provided so as to be movable relative to the first portion, the biasing member is a tension spring, and one end of the spring is connected to the holder and the other end of the spring is connected to the second portion.

12. The image forming apparatus according to claim 8, wherein one of the first portion and a portion of the engagement portion making contact with the first portion is elastically deformable.

13. The image forming apparatus according to claim 8, wherein one of the second portion and a portion of the engagement portion making contact with the second portion is elastically deformable.

14. An image forming apparatus comprising:

an apparatus body;

an opening-closing member configured to be opened and closed relative to the apparatus body;

a lock mechanism, provided in the apparatus body, configured to lock the opening-closing member in a closed position of the opening-closing member, the lock mechanism including a rotatable lock portion and a biasing member that biases the lock portion; and an engagement portion, provided in the opening-closing member, configured to engage with the lock portion, wherein the lock portion is rotated by being pressed by the engagement portion when the opening-closing member is closed relative to the apparatus body, wherein when the lock portion is rotated by being pressed by the engagement portion, a rotation moment acting on the lock portion by the biasing member is switched from a second direction, in which the engagement portion is pushed toward an opened position of the opening-closing member, to a first direction, in which the engagement portion is pushed toward the closed position of the opening-closing member, wherein the lock portion includes a first portion being contactable with a surface of the engagement portion and a second portion being contactable with an opposite surface of the engagement portion, wherein a relative positional relation between the first portion and the second portion varies, and wherein the first and second portions sandwich the engagement portion at a first timing earlier than a second timing at which the rotation moment is switched from the second direction to the first direction.

15. The image forming apparatus according to claim 14, wherein the engagement portion moves to the closed position in a state of being sandwiched by the first and second portions.

16. The image forming apparatus according to claim 14, wherein the relative positional relation between the first portion and the second portion at the first timing is wider than the relative positional relation between the first portion and the second portion when the second portion is not in contact with the engagement portion.

17. The image forming apparatus according to claim 14, wherein the lock mechanism includes a holder that rotatably holds the lock portion, wherein the second portion is provided so as to be movable relative to the first portion, the biasing member is a tension spring, and one end of the spring is connected to the holder and the other end of the spring is connected to the second portion.

18. The image forming apparatus according to claim 14, wherein one of the first portion and a portion of the engagement portion making contact with the first portion is elastically deformable.

19. The image forming apparatus according to claim 14, wherein one of the second portion and a portion of the engagement portion making contact with the second portion is elastically deformable.

20. An image forming apparatus comprising:

an apparatus body;

an opening-closing member configured to be opened and closed relative to the apparatus body;

a lock mechanism, provided in the apparatus body, configured to lock the opening-closing member in a closed position of the opening-closing member, the lock mechanism including a rotatable lock portion and a biasing member that biases the lock portion, wherein the lock mechanism is constituted by a toggle mechanism; and an engagement portion, provided in the opening-closing member, configured to engage with the lock portion, wherein the lock portion is rotated by being pressed by the engagement portion when the opening-closing member is closed relative to the apparatus body, wherein the lock portion includes a first portion being contactable with a surface of the engagement portion and a second portion being contactable with an opposite surface of the engagement portion, wherein a relative positional relation between the first portion and the second portion varies, and wherein the first and second portions sandwich the engagement portion at a timing before the lock portion passes a neutral point of the toggle mechanism.

* * * * *